United States Patent [19]

Honma et al.

[11] Patent Number: 4,472,049

[45] Date of Patent: Sep. 18, 1984

[54] IMAGE FORMING APPARATUS

[75] Inventors: Toshio Honma; Hiroshi Tanioka; Katsuyoshi Maeshima, all of Tokyo, Japan

[73] Assignee: Canon Kabushiki Kaisha, Tokyo, Japan

[21] Appl. No.: 370,478

[22] Filed: Apr. 21, 1982

[30] Foreign Application Priority Data

Apr. 28, 1981 [JP] Japan ..... 56-64839

[51] Int. Cl.[3] ..... G03G 15/00

[52] U.S. Cl. ..... 355/14 SH; 355/3 SH; 271/256

[58] Field of Search ..... 355/14 SH, 14 R, 3 SH, 355/3 R; 271/256, 258–261

[56] References Cited

U.S. PATENT DOCUMENTS 4,307,957 12/1981 Kitagawa et al. ..... 355/14 R

*Primary Examiner*—R. L. Moses

*Attorney, Agent, or Firm*—Fitzpatrick, Cella, Harper & Scinto

[57] ABSTRACT

An image forming apparatus such as a copying machine has a memory for storing a signal corresponding to the amount of movement of a paper feed roll. The paper is fed to an image forming station and a controller is provided for moving the paper feed roll to a predetermined rotation position when the operation of the apparatus is suspended by detection of a jam.

20 Claims, 15 Drawing Figures

IMAGE FORMING APPARATUS

BACKGROUND OF THE INVENTION

1. Field of the Invention

The present invention relates to an image forming apparatus such as a copying machine.

2. Description of Prior Art

In the past, a semicircular paper feed roll having a portion of a circumference cut away has been used as paper feed means. It is less expensive and more compact than a method in which papers are fed by moving up and down a rotating roll, but when a preceding paper jams during the paper feed operation, that is, while a roll surface is in contact with a paper and the machine is stopped, the roll is, in many cases, held in that position, and when the machine is restarted after the jam condition has been cleared the roll feeds out the paper by the return operation to a home position. As a result, in the above copy operation, a jam may occur or a misregistration of a copy image may occur. This problem is encountered in other paper feed means which use a rotating roll which is held in an interrupted condition when the machine operation is suspended.

Where another process movement member is held in the interrupted condition when the machine operation is suspended, the process is not started from a proper point when the machine operation is restarted and the first copy does not provide an acceptable copy.

If the machine operation is suspended by the detection of a jam immediately after the start of the paper feed operation, the machine stops with a leading edge of a paper slightly projecting from a paper cassette. In such a case, a trouble condition of the machine may not be detected by the observation of the machine through a machine door. If the machine is restarted from that condition, a jam may occur again or a misregistration may occur.

SUMMARY OF THE INVENTION

It is an object of the present invention to provide an image forming apparatus which enables proper restart of the machine after suspension.

It is another object of the present invention to provide an improved image forming apparatus which uses a semicircular roll as paper feed means.

It is another object of the present invention to provide an image forming apparatus which compensates for the operation of a process member having no position sensor.

It is a further object of the present invention to provide an image forming apparatus which moves a sheet to a position which an operator can readily observe.

The above and other objects of the present invention will be apparent from the following description of the preferred embodiments of the present invention.

BRIEF DESCRIPTION OF THE DRAWINGS

FIG. 4-1 shows an operation time chart for the apparatus of FIG. 1, FIG. 4-2 illustrates an operation of a paper feed roll.

DETAILED DESCRIPTION OF THE PREFERRED EMBODIMENTS

Figure 1:
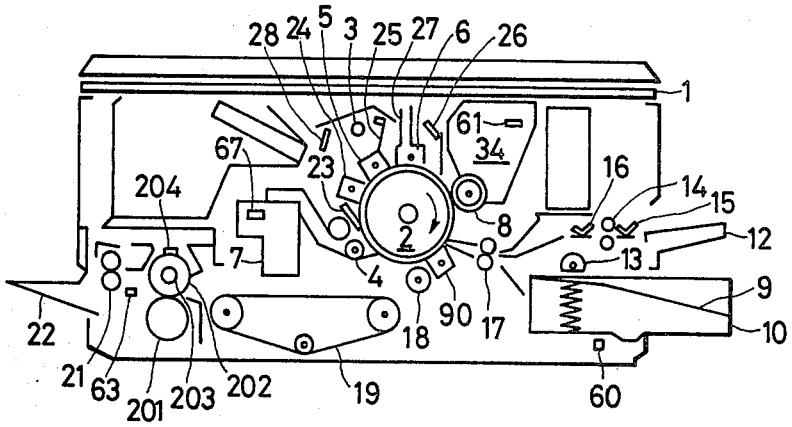
FIG. 1 shows a sectional view of one embodiment of an image forming apparatus of the present invention.

FIG. 1 shows a sectional view of one embodiment of a copying machine in accordance with the present invention. Numeral 1 denotes a reciprocating platen on which a text is mounted, numeral 2 denotes a rotating drum having a seamless photosensitive layer on a periphery thereof, numeral 3 denotes a lamp for exposing a text image to the drum 2, numeral 5 denotes a corona charger for positively precharging the photosensitive layer, numeral 6 denotes a corona charger for negatively discharging the photosensitive layer by the exposed image, numeral 8 denotes a developer for developing an electrostatic latent image, numeral 9 denotes a charger for transferring a developed image to a copy paper 10, numeral 11 denotes a cassette which contains a number of copy papers 10 and is removable from a main frame, numeral 12 denotes a table for allowing manual insertion of the copy paper 10, numeral 13 denotes a roll for feeding the copy paper 10 from the cassette 11, numeral 14 denotes a roll for feeding the copy paper from the manual insertion table, numerals 15 and 16 denote microswitches for sensing the manually inserted copy paper, numeral 17 denotes a registration roll for registering a leading edge of the copy paper with a leading edge of the drum image, numeral 18 denotes a roll for separating the copy paper from the drum, numeral 19 denotes a belt for conveying the copy paper, numeral 20 denotes a fixing roll, numeral 21 denotes a roll for ejecting the copy paper to a tray 22, numeral 23 denotes a blade cleaner for removing toners remaining on the drum, numeral 4 denotes a magnet roll for collecting toners removed by the blade cleaner 23, numeral 7 denotes a container for accommodating the toners collected by the roll 4, numeral 24 denotes a negative corona charger for removing charges remaining on the drum, numeral 25 denotes a shutter for imparting the light from the exposure lamp 3 to the drum surface for a predetermined time period, numerals 26 and 28 denote mirrors for imparting the light from the lamp 3 to the drum surface, and numeral 27 denotes a selfoc lens for focusing the reflected light of the lamp 3 from the text to the drum surface.

The operation is now explained. When a main switch is turned on, a motor for driving the drum 2 is energized, the lamp 3 is turned on, the shutter 25 is opened and the corona charger 6 is turned on, and the drum 2 is rotated. Thus, the toners, charges and memory remaining on the drum surface are cleaned. When the fixing roll 20 is heated to a fixing temperature by a heater contained therein, a copy signal is generated. If a copy switch is not turned on, the drum continues to rotate until a predetermined number of pulses generated by a rotary encoder which is arranged in a drum drive unit and generates n pulses per drum revolution have been counted, when the drum stops rotating. This drum rotation is called a first pre-rotation.

If the copy switch is turned on during the drum rotation or drum stop, the shutter 25 is closed and the drum 2 is rotated again. After approximately one revolution (called a second pre-rotation), the platen 1 starts to advance to start a slit exposure of the text mounted on the platen 1. The reflected image of the lamp 3 is slit-exposed to the drum through the selfoc lens. The photosensitive layer of the drum 2 comprises a surface insulative layer, an inner photoconductive layer and an innermost conductive layer. When the surface area charged by the charger 5 reaches the exposure area, the positive charges are discharged by the negative charger 6 and the light image. When the surface area reaches the flat exposure area, an electrostatic latent image of high contrast is formed on the drum surface by the light from the mirror 26. The latent image is developed at the developing station by applying the toner. The developed image is transferred to the copy paper at the transfer station by the positive potential of the transfer charger. The copy paper is separated and fed from the cassette 10 by the timing operation of the paper feed roll 13 and it passes through the transfer station by the registration roll 17 at the same speed as the circumferential speed of the drum. The transferred copy paper is separated by the roll 18 and fed to the fixing roll 20 by the belt 19 where the image is fixed. The fixed copy paper is then ejected to the tray 22 by the roll 21. The drum surface after the transfer operation is cleaned by the blade 23, discharged by the charger 24 and cleared for the memory by the light of the lamp 3 from the mirror 28.

When the same text is to be continuously copied, the platen 1 repeats the reciprocation by the number of times set by a ten-key on a control panel of the copying machine.

Figure 2:
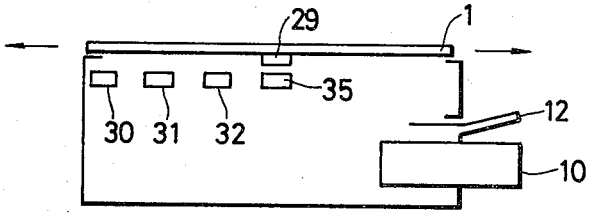
FIG. 2 shows a sectional view of a text table shown in FIG. 1.

FIG. 2 shows the platen and associated parts. A magnet 29 is mounted on the platen and reed switches 30, 31, 32 and 35 are arranged along a travel path of the platen so that they are actuated by the magnet 29 as it passes by. When the reed switch 35 is actuated by the magnet 29, the text table is stopped at an initial position at the center of the machine frame, and when the reed switch 30 is actuated the text table is advanced to the right for the slit exposure. The reed switch 31 is used to start the paper feed by the paper feed rolls 13 and 14, and the reed switch 32 is used to start the paper feed by the registration roll 17. In the continuous copying operation, when the first slit exposure is completed and the text table retracts to actuate the reed switch 30, the text table again starts to advance to effect the second scan. In this manner, as many copies as is preset are formed. The lamp 3 and the charger 6 are turned on and off in synchronism with the rotation of the main motor or the drum, and the primary charger 5 and the pre-charger 24 are turned on except during a post-rotation cycle. The lamp 3 is controlled to emit a high intensity light during the scanning operation of the text table.

In the manual insertion copying operation, when a sheet is inserted from the table 12, the sensor 15 senses the sheet and the paper feed roll 14 is turned on to take the sheet into the machine. However, the roll 14 is not turned on for a predetermined time period (approximately two seconds) after the detection of the sheet by the sensor 15, in order to prevent a skewed insertion or correct a skewed sheet, or allow the exchange of sheet. After the predetermined time period, the roll 14 is turned on and the drum 2 is rotated and the same process sequence as that for the turn-on of the copy switch is started. The second pre-rotation of the drum 2 is started upon the detection of the sheet by the sensor 15 in order to shorten a waiting time for the start of the copy operation. When the sensor 15 senses the insertion of the sheet, the paper feed from the cassette is inhibited. In this manner, the copy operation is started by merely inserting the sheet without turning on the copy switch on the control panel and the sheet is fed into the machine with a correct positional relationship so that the toner image is transferred at a correct position on the sheet and the jam of the sheet is prevented.

When the switch 16 detects that the trailing edge of the sheet has passed the switch 16, the roll 14 is turned off and is ready for the insertion of the next sheet.

A plurality of sensors 15 may be arranged transversely to the direction of the sheet feed in order to detect the skew of the sheet. The roll 14 is not turned on until all of the sensors sense the sheet.

Figure 3:
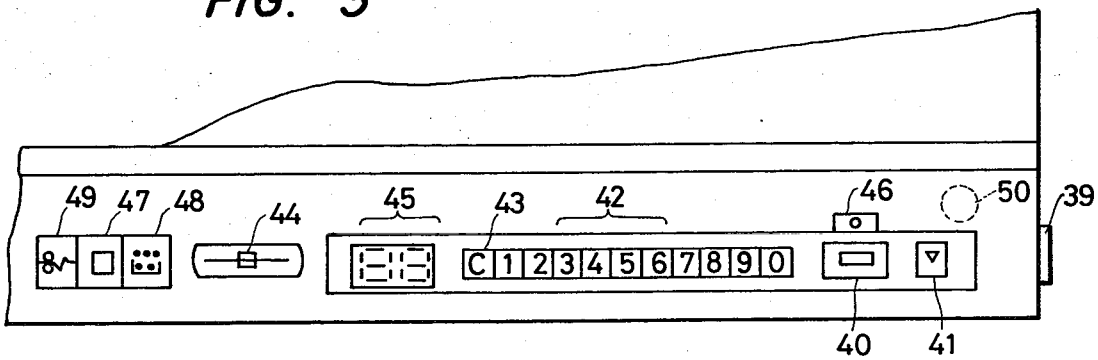
FIG. 3 shows a partial plan view of FIG. 1.

FIG. 3 shows a plan view of the control panel of the copying machine shown in FIG. 1. Numeral 39 denotes a power main switch, numeral 40 denotes a copy start key switch, numeral 41 denotes a stop key switch for interrupting continuous copying operation, numeral 42 denotes a ten-key for entering the number of times of the continuous copying operation into a memory, numeral 43 denotes a clear key for clearing the content of the memory, numeral 44 denotes a copy density setting lever, numeral 45 denotes a seven-segment display for the memory content, numeral 46 denotes a wait lamp which is turned on until the fixing roll is heated to the fixing temperature, numeral 47 denotes a lamp for indicating the absence of the cassette and the paper in the cassette, numeral 48 denotes a lamp which is turned on when the container 7 for recovering the used toners is full of toners, and numeral 49 denotes a lamp to indicate a jam of the paper. The clear key and the ten-key are not operative during the jam but they are operative during the waiting condition.

When the copy paper jams, the operation of the dangerous charger is stopped to secure safety. The machine operation is not immediately stopped by the stop key signal, the absence of paper signal and the absence of cassette signal but the current process cycle is continued and the start of the next cycle is inhibited.

Figures 1, 4:
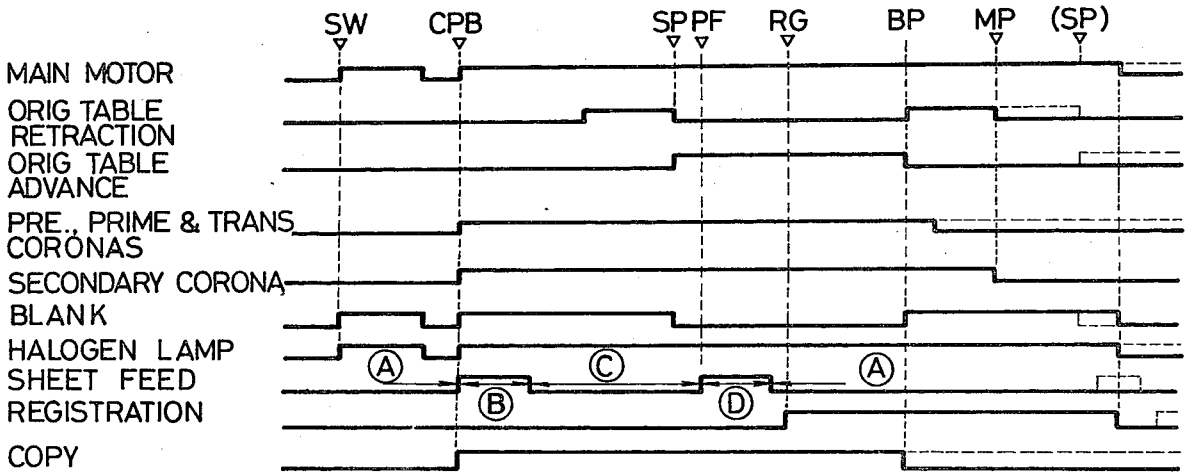
Figures 2, 4:
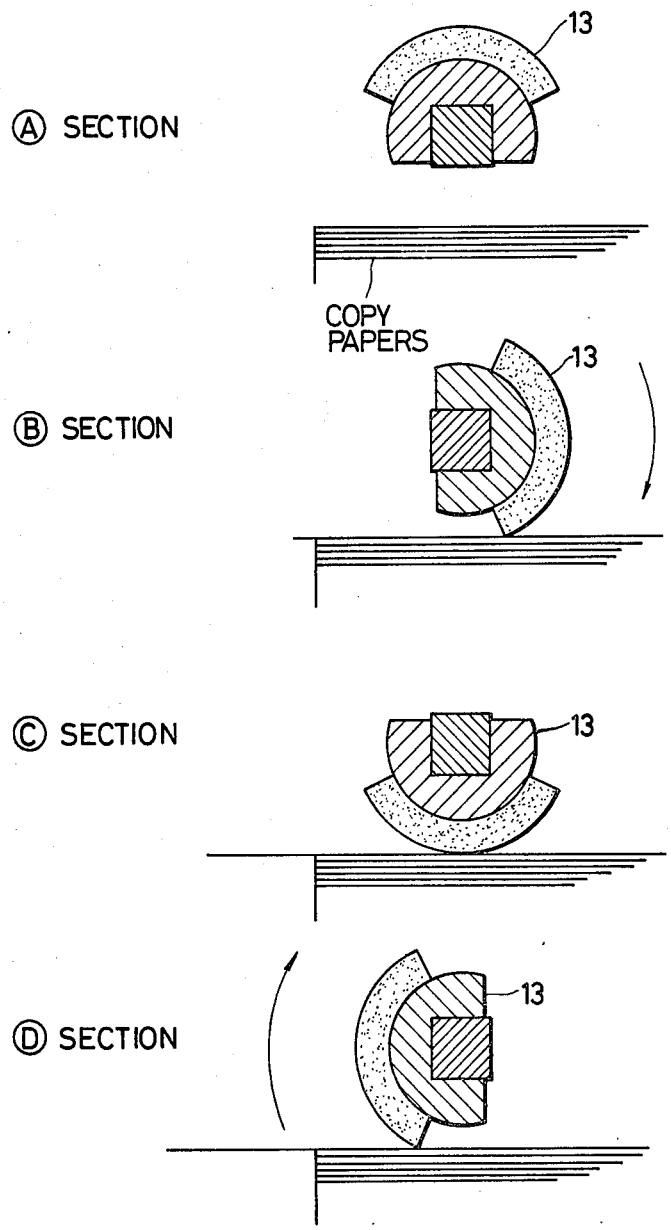

FIG. 4-1 shows an operation timing chart for the apparatus of FIG. 1. Referring to FIG. 4-1, the operation sequence and the operation timing of the scan operation are explained in detail.

Before the copy switch 40 is turned on, the platen 1 is positioned at the center of the main frame as shown in FIG. 1. When the copy switch 40 is turned on, the predischarger 24, the lamp 3, the primary charger 5, the secondary charger 6, the transfer charger 9 and the shutter 25 are turned on to apply the pre-corona, the primary corona, the secondary corona, the transfer corona, the predischarging exposure, the blank exposure and the flat exposure to the photosensitive layer, for preparation of the start of the copy operation. The lamp 3 lights at a low intensity.

When the predetermined number of pulses have been counted, that is, when the drum has been rotated by the predetermined number of rotations, the platen 1 is moved to the left from the position shown in FIG. 1 and the switch 30 is turned on when the drum completes approximately one revolution. Then, the platen is stopped and moved to the right for the exposure. The lamp 3 now lights at a high intensity, the shutter is closed and the blank exposure is stopped. The blank exposure serves to irradiate light to the image exposure surface during the non-exposure period of the image to prevent nonuniform potential distribution from appearing on the photosensitive layer.

After the image exposure for approximately one and a half revolutions of the drum, the platen 1 is stopped and moved to the left. This movement is started when a predetermined number of pulses have been counted. The number stored in the memory is loaded to a copy counter register and the content thereof is decremented by one. As a result, the content of the register changes to "0" if one copy is to be made and the restart of the copying operation is inhibited. During the rightward advancement, the reed switch 31 shown in FIG. 2 is turned on to turn on the paper feed rolls 13 and 14, and the reed switch 32 is turned on to turn on the registration roll 17 so that the paper is fed. The rolls 13, 14 and 17 are not turned on if the reed switches 31 and 32 are turned on during the platen movement in other than the exposure period.

When the platen 1 turns on the switch 35 at the initial position, it stops moving. The lamp 3 is switched to the low intensity mode and the shutter is opened to start the blank exposure by the low intensity lamp 3. The drum continues to rotate to electrically and mechanically clean the photosensitive layer. After approximately one revolution, the process loads shown in FIG. 4 are turned off and the drum stops rotating. The power supply is kept on after the stop of the drum rotation.

In the continuous copying operation, the platen 1 is not stopped when the switch 35 is turned on but continues to move to the left. When the switch 30 is turned on, the platen 1 starts to move to the right and the lamp 3 is switched to the high intensity mode, the shutter is closed and the image exposure is started. In the first copy cycle, if the break of a thermistor 204, the overflow, the absence of toner, the lack of paper or the absence of cassette/paper is detected, the process follows the solid lines shown in FIG. 4-1, and in a normal condition, the process follows the broken lines.

The timing at which the rightward movement for the exposure is stopped and the movement is reversed is determined by the size of the paper from the cassette 10 or the manual insertion table 12. When the break of the thermistor is detected, the wait signal is produced.

FIG. 4-2 shows the positions of the cassette roll in the sections Ⓐ, Ⓑ, Ⓒ and Ⓓ of the cassette roll signal shown in the timing chart of FIG. 4-1.

Figure 5:
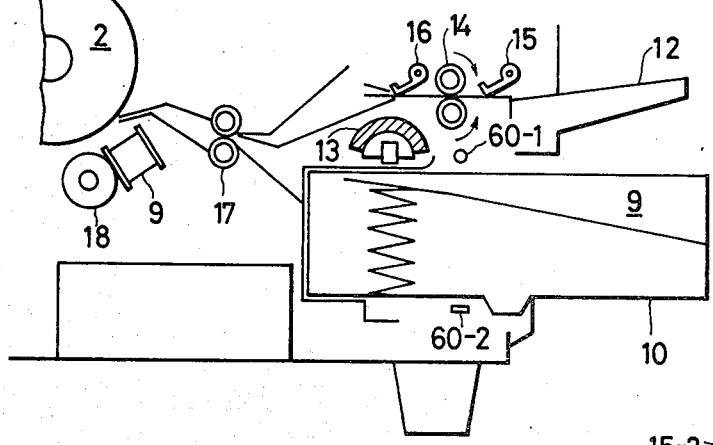
FIG. 5 shows a sectional view of a paper feed station shown in FIG. 1.
Figure 6:
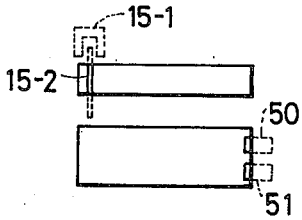
FIG. 6 shows a right front view of FIG. 5, FIGS. 7-1A, 7-1B and 7-2 show control circuits shown in FIG. 1, FIGS. 8-1 to 8-3 show control timing charts for the circuit of FIG. 7-2.

FIG. 5 shows a longitudinal sectional view of the cassette unit and the manual insertion unit, and FIG. 6 shows a side plan view thereof. Numeral 15-1 denotes a photointerrupter which forms the manually inserted sheet sensor 15, numeral 15-2 denotes an actuator which rocks when the sheet is inserted, numerals 50 and 51 denote microswitches which are actuated by a cam attached to the cassette when the cassette is loaded to the machine frame. When both the microswitches 50 and 51 are off, a signal indicating the absence of the cassette is produced, when the microswitch 50 is on and the microswitch 51 is off, a signal indicating the cassette of half size papers or A4 or B5 size papers is produced, when the microswitch 50 is off and the microswitch 51 is on, a signal indicating the cassette of B4 size papers is produced, and when both the microswitches 50 and 51 are on, a signal indicating the cassette of full size papers or A3 or B4 size papers is produced. The three paper size signals are used to determine the exposure stroke of the platen 1.

For the manually inserted sheet, the B4 size is treated as the full size and hence either the half size or the full size is detected by the sheet sensor 15.

When a number of copies are made by continuously feeding the papers from the cassette, the copy cycle is repeated in the stroke corresponding to the paper size, that is, in a minimum cycle time so that a copy time is minimized. In the manual insertion operation, since the sheets cannot be continuously fed in, the two-stroke control is sufficient. Thus, the control circuit is simplified and the malfunction in the size detection is minimized.

The actuator of the sheet sensor 15 is positioned at the left end as shown in FIG. 6. This position faces a belt which separates the copy paper from the drum after the transfer and is arranged beyond the image forming area of the drum. Accordingly, it can detect whether the manually inserted sheet has been inserted to a proper position to allow the separation.

The sheet sensor 16 is positioned at the left end relative to the photosensitive layer as is done for the sensor 15. The sensor 16 has three functions. First, it detects the size of the manually inserted sheet. If the sensor 16 does not sense the sheet at a predetermined timing, it determines the half size, and when it senses the sheet it determines the full size. Secondly, it renders a path length from the leading edge of the manually inserted sheet to the registration roll to be equal to a path length from the cassette paper to the registration roll. When the sheet fed in by the manual insertion roll 14 is sensed by the sensor 16, the roll 14 is turned off after a predetermined time period and waits for the feed of the sheet to the registration roll. The roll 14 is turned on again by the signal from the reed switch 31 to start the paper feed to the registration roll. Thirdly, when the sensor 16 senses the trailing edge of the sheet, the roll 14 is stopped, to be ready for the next sheet insertion.

The pre-feed operation, in which the roll 14 is turned on upon the detection of the sheet by the sheet sensor 15 and the roll 14 is turned off upon the detection of the sheet by the sensor 16, serves to prevent the adverse effect to the function of the registration roll and restrict the looping of the sheet caused by the stationary registration roll to an acceptable range. Accordingly, the holding or the jam of the sheet is prevented.

The same is true for the paper feed operation from the cassette. When the copy switch is turned on, the paper feed roll 13 is turned on for a short time period to pull out the paper from the cassette. The reed switch 31 causes the pulled-out paper to be fed to the registration roll. The cassette roll 13 is of semi-circular shape and effects the pre-feed operation during one half revolution from the position shown in FIG. 5 and the main feed operation during the next half revolution.

Figures 1A, 7:
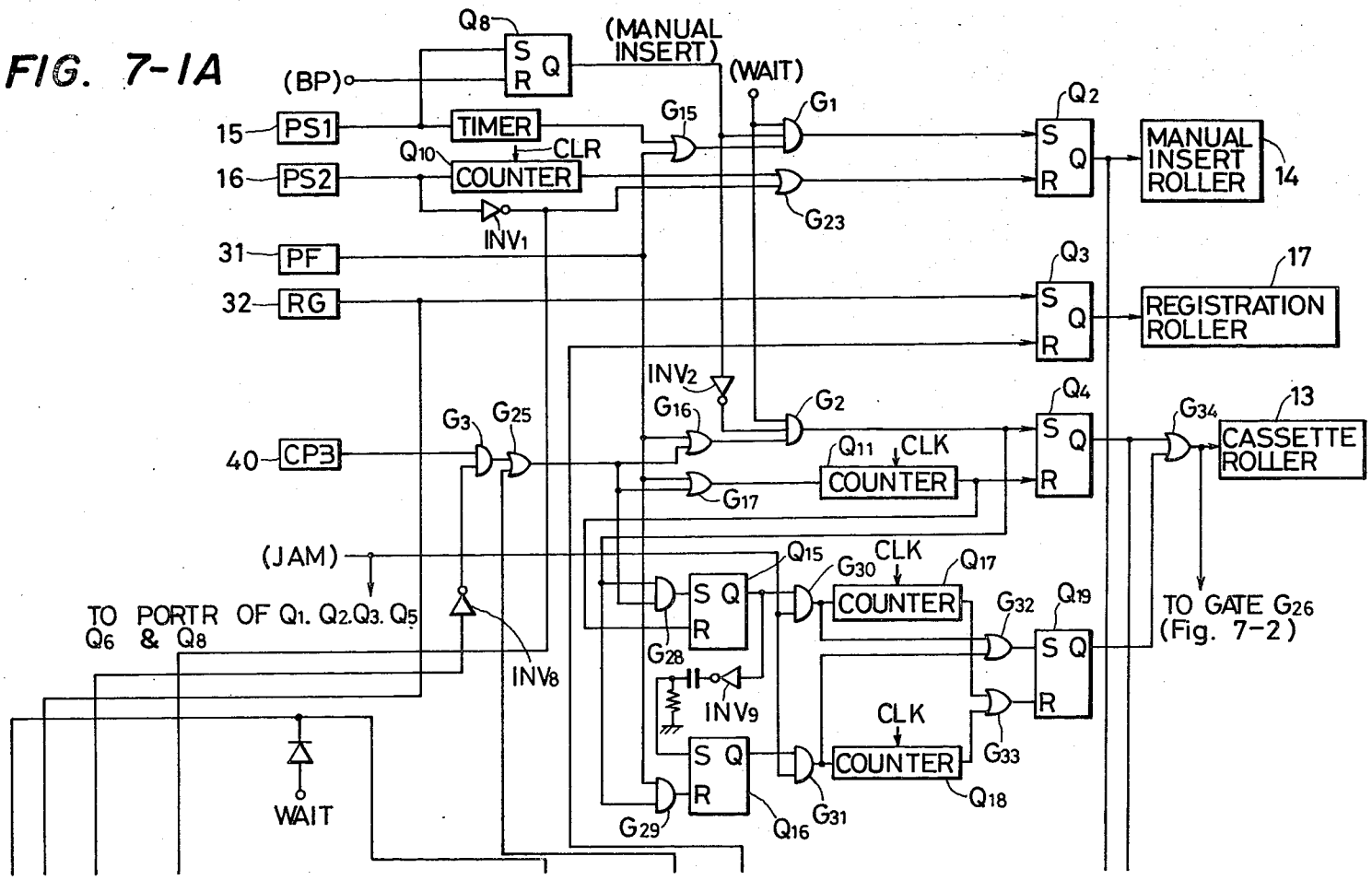
Figures 1B, 7:
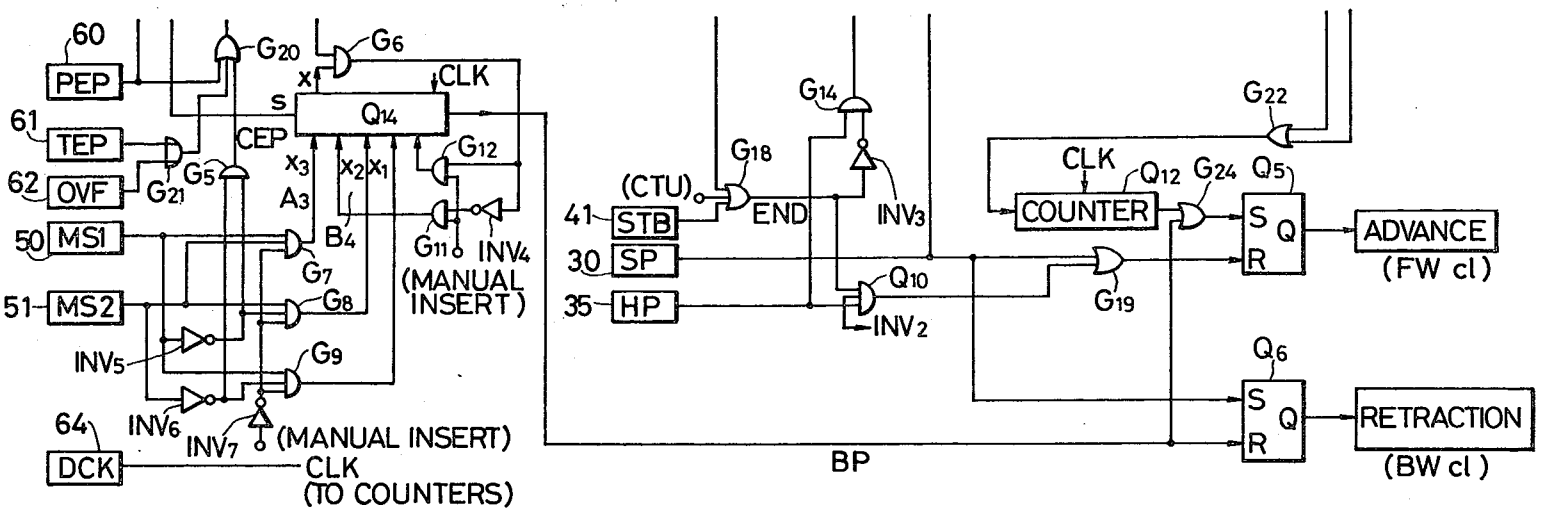
Figures 2, 7:
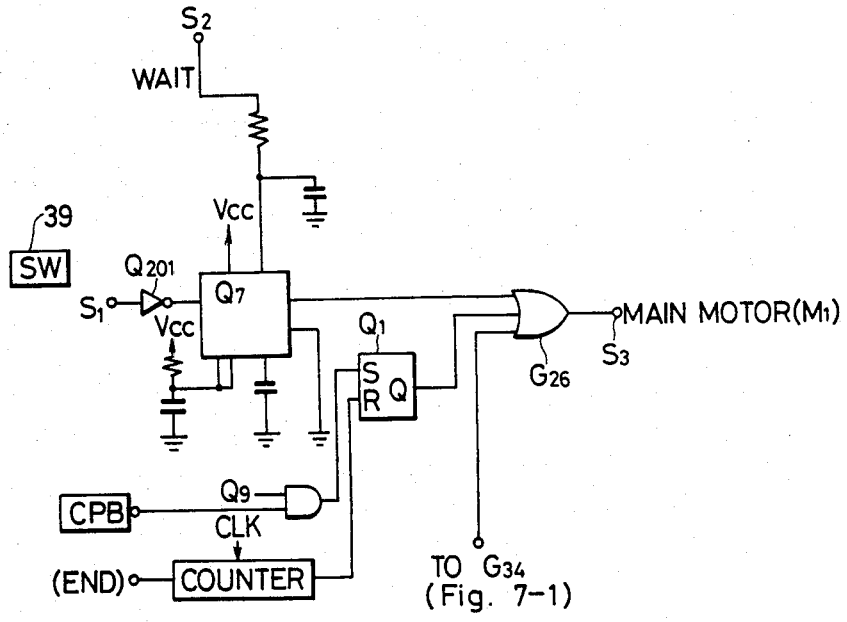
Figures 1, 8:
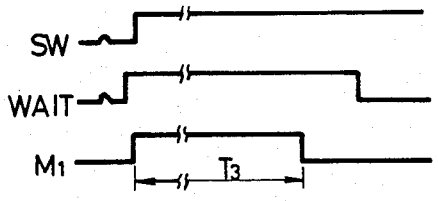
Figures 2, 8:
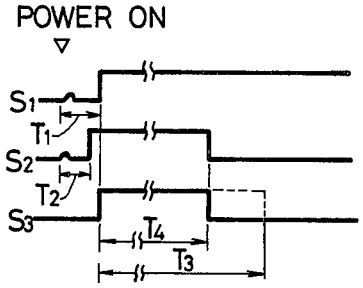
Figures 3, 8:
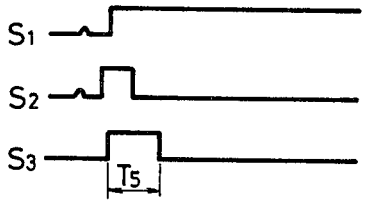
Figure 9:
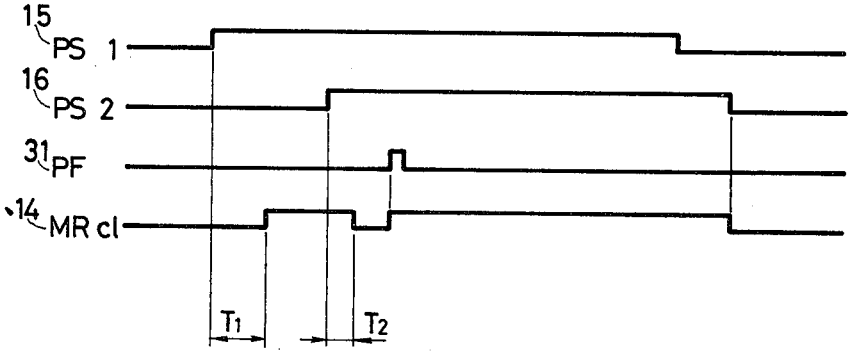
FIG. 9 shows a control timing chart for the circuit of FIGS. 7-1A and 7-1B.

FIG. 7 shows a control circuit for the copying machine shown in FIG. 1. $Q_1$–$Q_6$ denote flip-flops for controlling the main motor (for driving the drum 2, the rolls and the belt 19), a clutch for driving the manual insertion drum 14, a clutch for driving the registration roll 17, a clutch for driving the cassette roll 13, a clutch for retracting the text table 1 and a clutch for advancing the text table 1, respectively. Each of the flip-flops $Q_1$–$Q_6$ is set by a positive-going pulse signal applied to a port S and reset by a positive-going pulse signal applied to a port R. $Q_7$ denotes a one-shot multivibrator to effect wait control for the main motor and produces an output of a duration T3 as shown in FIG. 8 when the main switch is turned on. $Q_8$ denotes a flip-flop for detecting the manual insertion mode. The functions of the ports S and R are identical to those of $Q_1$ except that $Q_8$ is not an edge trigger. $Q_9$ denotes a timer for activating the manual insertion roll 14 and produces an output after a time period T1 as shown in FIG. 9 on the condition that an input signal is on for the time period T1. $Q_{10}$–$Q_{13}$, $Q_{17}$ and $Q_{18}$ denote a counter which counts the clock pulses generated by the drum rotation from the time of the application of the input signal and produces a pulse output when a predetermined count is reached. The counters $Q_{10}$ and $Q_{11}$ determine the timing to turn off the manual insertion roll and the cassette roll, respectively, the counters $Q_{12}$ and $Q_{13}$ determine the number of pre-rotations and the number of post-rotations, respectively, and the counters $Q_{17}$ and $Q_{18}$ determine the activation time of the cassette roll in the jam condition. The clock pulses DCK are generated by the rotary encoder at a constant interval, N pulses per drum revolution. $Q_{14}$ denotes a counter similar to the counters $Q_{10}$–$Q_{13}$, $Q_{17}$ and $Q_{18}$, and it selects a preset number corresponding to the cassette paper size in the cassette mode and selects a preset number corresponding to the manually inserted sheet size in the manual insertion mode. $Q_{15}$ and $Q_{16}$ denote flip-flops which store the rotating condition (rotating position) of the cassette roll. $Q_{19}$ denotes a flip-flop for activating the cassette roll when the jam occurs. The reset time thereof is determined by the flip-flops $Q_{15}$ and $Q_{16}$. G1–G10 and G27–G31 denote AND gates, G15–G26 and G32–G34 denote OR gates and INV1–INV7 denote inverters.

$M_1$, MRCl, RGCl, CRCl, FWCl and BWCl denote signals which turn on the main motor, the manual insertion roll, the registration roll, the cassette roll, the text table advance and the text table retraction, respectively, when they are "1" and turn them off when they are "0", CLK denotes a clock pulse, BP denotes a signal for reversing the text table, END denotes a copy cycle stop signal which is caused by a stop key signal STB, a count-up signal CTU and paper/cassette empty signals PEP and CEP. MI denotes a signal indicating the manual insertion mode, JAM denotes a signal indicating the jam condition of the paper which is generated by the detection of the jam, CTU denotes a count-up signal of the copy counter for indicating the completion of the preset number of copies, SW denotes a main switch on signal, PS1 and PS2 denote signals which are produced upon the detection of the manually inserted sheet by the sensors 15 and 16, respectively, PF and RG denote a paper feed signal and a registration signal which are produced when the reed switches 31 and 32, respectively, are turned on by the text table, CPB and STB denote signals which are produced when the copy button and the stop key on the control panel are depressed, SP and HP denote signals which are produced when the reed switches 30 and 35 are turned on by the text table and indicate the start position and the stop position of the text table advancement, PEP denotes a signal which is produced when a lamp 60-1 and a photosensor 60-2 optically detects the empty condition of the papers in the cassette 10, CEP denotes a signal which indicates an unloaded condition of the cassette 10 and is produced by the microswitches 50 and 51 which are actuated by the loading of the cassette, TEP denotes a signal which indicates the empty condition of the toners in the developer 34 and is produced when a toner level detector 61 in the developer container detects that the toner level is lower than a reference level, OVF denotes a signal which indicates the overflow condition of the toner recovered in the container 7 and is produced by a level detector 62, and WAIT denotes a signal which indicates the waiting condition and is produced by a thermistor Th which senses the temperature of the fixing roll.

Figure 10:
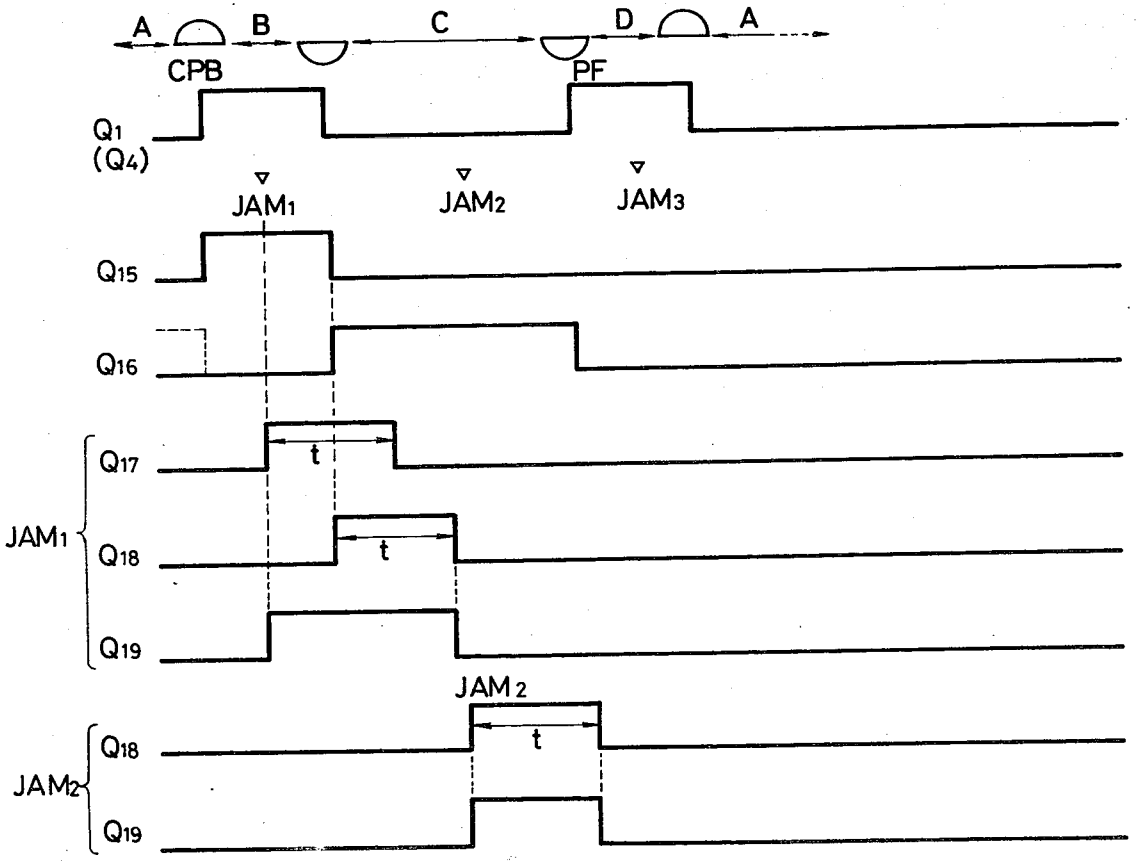
FIG. 10 shows a timing chart for the circuit of FIGS. 7-1A and 7-1B.

Referring to the time charts of FIGS. 4-1 and 10, the operation is now explained. During the wait signal WAIT produced by the turn-on of the power supply 39, the one-shot $Q_7$ of FIG. 7 is activated so that the main motor signal $M_1$ is gated out through the gate G26 for the time period T3 to effect the first pre-rotation of the drum. When the copy button is depressed during the stand-by period after the wait period (WAIT signal "0"), the flip-flop $Q_1$ is set and the main motor is energized to start the process.

Assuming that no sheet is now inserted from the manual insertion table 12, the sensor 15 is off, the flip-flop $Q_8$ is off and the manual insertion signal MI is not produced. Accordingly, the gate G1 is off and the flip-flop $Q_2$ is not set and hence the manual insertion roll 14 is not activated.

Assuming that the paper empty signal PEP, the toner empty signal TEP and the overflow signal OVF are now not produced, the start signal is applied to the gate G2 through the gates G3, G25 and G16 upon the depression of the copy key. The wait signal and the inverted manual insertion signal (all "1") are applied to the other input ports of the gate G2. Accordingly, the flip-flop $Q_4$ is set and the clutch of the cassette roll 13 is activated. While the counter $Q_{11}$ counts up the predetermined number of pulses through the gate G17, the roll 13 rotates one-half revolution so that the paper is pulled out of the cassette by approximately one-half length of the paper. When the counter $Q_{11}$ counts up, the flip-flop $Q_{15}$ is reset. Thus, the flip-flop $Q_{15}$ is set for the section (B) of the timing chart of FIG. 4-1 (see FIG. 10). When the flip-flop $Q_{15}$ is reset, the flip-flop $Q_{16}$ for storing the cassette roll rotation position is set through the inverter INV7 and the succeeding differentiation circuit.

The output of the flip-flop $Q_4$ causes the counter $Q_{12}$ to start to count the clock pulses CLK through the gate G22. After the predetermined clock pulses CLK have been counted, the flip-flop $Q_5$ is set through the OR gate G24 to turn on the clutch signal FWCl so that the text table is moved to the left. When the reed switch 30 is turned on by the text table, the flip-flop $Q_5$ is reset through the gate G19 and the clutch signal FWCl is turned off, and on the other hand, the flip-flop $Q_6$ is set to turn on the clutch signal BWCl so that the text table is moved to the right. The image exposure lamp 3 is turned on in synchronism with the main motor M1 and the light intensity thereof is controlled by the clutch signal BWCl. The light intensity is high when the signal BWCl is on. The reset timing of the flip-flop $Q_6$ at which the first slit exposure is terminated is determined by the cassette switches 50 and 51.

When the switches 50 and 51 are "1" and "0", respectively, it indicates that the A4 size papers are in the cassette and hence the exposure stroke is terminated in accordance with the length of the A4 size paper. The counter $Q_{14}$ which counts the clock pulses to determine the reversal position is preset to a count n1 corresponding to the A4 size. For the B4 size, the switches 50 and 51 are "0" and "1", respectively, and the counter $Q_{14}$ is preset to a count n2 which is larger than n1. For the A3 size, the switches 50 and 51 are "1" and "1", respectively, and the counter $Q_{14}$ is preset to a count n3 which is larger than n2. When the switches 50 and 51 are "0" and "0", respectively, the cassette empty signal CEP is produced through the gate $Q_5$.

The counter $Q_{14}$ counts the pulses after the registration switch 32 has been turned on and produces the signal BP when the count reaches n1–n3 to reset the flip-flop $Q_3$ to stop the advancement of the text table. The signal BP sets the flip-flop $Q_5$ through the gate G24 to move the text table to the left, and when the reed switch 35 is turned on by the text table the flip-flop $Q_5$ is reset to stop the backward movement.

If the switch 31 is turned on in the course of the forward movement of the text table, the signal PF is supplied to the gates G1 and G2 and the counter $Q_{11}$ through the gates G15, G16 and G17. Since the gate G1 is off, the flip-flop $Q_2$ is not set and the paper feed flip-flop $Q_4$ is again set by the turn-on of the gate G2 so that the roll 13 is further rotated to pull out the partially pulled-out paper. The leading edge of the paper thus abuts against the registration roll 17 so that the paper is looped. In this manner, the paper is stopped at the registration roll with an appropriate loop and no serious attention is necessary to the distance between the paper feed roll and the registration roll. Because the loop is maintained at an appropriate constant size, the jam of the paper is reduced. The same concept is used for the manual insertion (as will be explained later).

The signal PF is applied to the port R of the flip-flop $Q_{16}$ through the gate G29 to reset the flip-flop $Q_{16}$. Thus, the flip-flop $Q_{16}$ is set for the section Ⓒ of the timing chart of FIG. 4-1 (see FIG. 10).

When the registration switch 32 is thereafter turned on, the flip-flop $Q_3$ is turned on to activate the roll 17. The roll 17 continues to rotate until the start switch 30 is next turned on.

In the multiple copy operation by the preset number, the gate G10 is not turned on at the end of the first process cycle and the flip-flop $Q_5$ is not reset when the stop switch 35 is turned on. Accordingly, the text table continues to move backward, and when the start switch 30 is turned on the flip-flop $Q_5$ is reset to stop the backward movement. The flip-flop $Q_6$ is again set to start the second forward movement exposure. The gate G10 is turned on by the END signal caused by the signal STB from the stop key 41, the paper empty and cassette empty signals PEP and CEP and the copy end signal CTU. Thus, the gate G10 controls the signal HP such that the scan is repeated until the preset number of copy cycles are completed, or the interrupt signal is produced by the stop key or the paper empty signal. The signal HP sets the flip-flop $Q_4$ through the gates G4, G25, G16 and G2 to feed the second and following papers. The flip-flop $Q_{15}$ is set through the gate G28.

The manual insertion mode is now explained in detail. The operator mounts a sheet on the table 12 and pushes it toward the roll 14. The sensor 15 checks if the sheet has been properly inserted. When the signal $PS_1$ is produced, the timer $Q_9$ is turned on to time the time period $T_1$. Before the termination of the time period $T_1$, the orientation of the sheet may be corrected and the sheet is abutted against the roll 14, which is now stopped, orthogonally to the roll 14. Thus, the position of the sheet can be corrected for a short time period after the insertion of the sheet so that the jam due to the skew of the sheet can be prevented.

After the time period $T_1$ has elapsed, the flip-flop $Q_2$ is set through the gates G15 and G1, and the flip-flop $Q_1$ is set through the gate G27. The MI input to the gate G1 is now "1" because the flip-flop $Q_8$ is set by the switch 15. Since the gate G2 is inhibited through the inverter, the drive of the cassette roll 13 is inhibited even if the signal PF is produced. The drum is rotated by the flip-flop $Q_1$ and the manual insertion roll 14 is rotated by the flip-flop $Q_2$ so that the sheet is fed into the machine. When the sheet arrives at the sensor 16 positioned rearward of the roll 14, the sensor 16 produces the signal $PS_2$ to start the count operation by the counter $Q_{10}$. When the counter counts up after the time period $T_2$, the flip-flop $Q_2$ is reset through the gate G23 to stop the roll 14, which then waits for the next feed step. This corresponds to the pre-feed operation from the cassette in the cassette mode. Whether the platen 1 is moved forward or backward, the pre-feed operation is carried out when the manually inserted sheet is sensed by the sensor 15.

When the roll 14 is activated, the pre-rotation counter $Q_{12}$ is started through the gate G22, and after the predetermined number of rotations the flip-flop $Q_5$ is set so that the text table is moved to the left as is done in the cassette mode, and when the start switch 30 is turned on by the text table the exposing forward movement is started.

In this manner, in the manual insertion mode, the copy cycle can be started without turning on the copy switch 40 and hence the operation is facilitated.

When the switch 31 is turned on during the exposing forward movement, the flip-flop $Q_2$ is again set through the gates G15 and G1 to activate the roll 14 so that the sheet is fed to abut against the registration roll. When the switch 32 is turned on, the flip-flop $Q_3$ is set as is done in the cassette mode to activate the registration roll 13 to feed the sheet to the transfer station.

As the sheet moves off the sensor 16, the flip-flop $Q_2$ is preset through the inverter and the gate G23 to stop the rotation of the manual insertion roll 14. This is to prepare for the next sheet feed.

In the manual insertion mode, the copy operation can be started or restarted even if the cassette empty signal, the paper empty signal, the toner empty signal or the overflow signal is produced. In the manual insertion operation, several copies at most will be continuously made. Accordingly, even if the signal TEP or OVF is produced, it does not significantly affect the image quality and the machine operation. This method is based on the simplicity of the operation. However, it is possible to allow the start of the first copy but inhibit the restart of the following copy or to inhibit the start of any copy.

It is possible to continue the timer operation of the timer $Q_9$ even if the sheet instantaneously moves off the sensor 15 during the time period $T_1$ while minimizing the skew of the sheet.

Since the sensors 15 and 16 are positioned to extend to the sheet separation position, they can also serve to position the sheet. Thus, the copy is made at a proper position on a small sheet such as a post card.

The reversal control of the text table in the manual insertion mode is explained. In FIG. 7, the signal $PS_2$ from the sheet sensor 16 and a predetermined count signal x of the counter $Q_{14}$ are applied to the inputs of the gate G6 in order to select one of the preset counts n1 and n3 of the counter $Q_{14}$. The counter $Q_{14}$ starts to count from the registration signal RG and determines the large (full) size such as A3 or B4 size when the sheet is present at the rearward sensor 16 when the predetermined number of pulses have been counted and determines the small (half) size such as A4 size when the sheet is not present to bisect the scan stroke. When x is "1" and $PS_2$ is "0" (which is inverted by the inverter to "1" before it is applied to the gate G6), the count n1 is preset to the counter $Q_{14}$. When x is "1" and the sensor 16 still senses the sheet, "0" is applied to the gate G6 and the count n3 is preset to the counter $Q_{14}$ through the inverter and the gate. As a result, the counter in the manual insertion mode continues to count to n3 or n1 depending on the full size or half size after the count x and produces the reversal signal BP. If the sheet is manually inserted during the backward movement, the output of the inverter INV2 changes to "0" and the gate G10 is turned off. As a result, the switch 35 does not stop the platen and the platen continues the cycle.

It is important to note that since the sheet has already been fed to the registration roll 17 the timing signal x for the sensing by the sheet sensor 16 is smaller than the count n1 for the A4 size and generates at a time before the end of the stroke for the A4 size.

In this manner, the size data of the manually inserted sheet need not be inputted by some means but the sheet size is sequentially determined during the process sequence control. Thus, the present embodiment contributes to the sequence control and simplifies the circuit construction.

In the multiple copy mode of the cassette mode, since it is desired to increase the speed as high as possible and set the stroke corresponding to a selected one of various copy sizes, three sorts of preset counts are used. In the manual insertion mode, however, the two stroke modes are sufficient because several copies at most are made. In this manner the control mode in the manual insertion operation is simplified as much as possible to minimize the trouble.

The copy stop instruction in the cassette mode is now explained. The restart by the copy key is inhibited by the signals PEP, TEP, CEP and OVF. Before the completion of the multiple copies, the gate G1 produces the signal END by the stop key signal STB and the signals PEP and CEP to inhibit the gate G4 to prevent the pre-feed operation of the paper feed roll 13. As a result, the multiple copy operation is interrupted. For the stop key, the copy operation is restarted by the depression of the copy key. For the signals TEP and OVF, the multiple copy operation is not interrupted but completed.

It is possible to divide the sense timing of the sensor 16 in the manual insertion mode to $x \ldots x_n$ to effect various stroke controls, and it is also possible to preset the counter $Q_{14}$ to a number different from the number in the cassette mode.

The flip-flop Q for setting the manual insertion mode is reset by the reversal signal BP or the jam signal JAM. The sheet can be manually inserted when the text table is moved backward after the light exposure so that the copy operation can be quickly restarted. By starting the timer $Q_9$ by the AND function of the inverted toner empty signal from the gate G21 and the sense signal $PS_1$, the manual insertion mode can be inhibited when the signals OVF are TEP and "1".

The operation when a jam has occurred is now explained. When the paper from the cassette jams, the jam signal JAM is applied to the ports R of the flip-flops $Q_1$, $Q_2$, $Q_3$, $Q_5$, $Q_6$ and $Q_8$ so that the operation of the clutches and the main motor corresponding to the respective flip-flop are deactivated before the end of the process, but the cassette roll and the main motor continue to rotate if one of the flip-flops $Q_{15}$ and $Q_{16}$ for storing the rotation position of the cassette roll 13 and the flip-flop $Q_4$ for activating the cassette roll is in the set state when the jam occurs.

When the jam occurs during the set state of the flip-flop $Q_{15}$ (JAM 1), the flip-flop $Q_{19}$ is set by the jam signal JAM through the gates G30 and G32 so that the clutch for the cassette roll is activated through the gate G34. The main motor continues to run through the gate G26. The main motor and the cassette roll continue to rotate while the counter $Q_{17}$ triggered through the gate G30 counts the predetermined number of pulses and then stop rotating and waits for the completion of the jam process. The pulse count of the counter $Q_{17}$ corresponds to a time period required for the rotation of the cassette roll from the position stored by the cassette roll rotation position storing flip-flop $Q_{15}$, that is, the position of the section (B) of FIG. 4-2 to the initial position of the cassette roll, that is, the position of the section (A). Since the flip-flop $Q_{16}$ is set to allow the rotation by the counter $Q_{18}$ as shown in FIG. 10, the count of the counter $Q_{17}$ may be the count of the counter $Q_{18}$.

When the jam occurs during the set state of the flip-flop $Q_{16}$ (JAM 2), the flip-flop $Q_{19}$ is set through the gates G31 and G32, and the main motor and the cassette roll continue to rotate while the counter $Q_{18}$ counts the predetermined number of pulses. The pulse count of the counter $Q_{18}$ corresponds to a time period required for the rotation of the cassette roll from the position stored in the cassette roll rotation position storing flip-flop $Q_{16}$, that is, the position of the section (C) in FIG. 4-2 to the intial position of the cassette roll, that is, the position of the section (A).

If the cassette roll is at the position of the section (D) in FIG. 4-2, the flip-flop $Q_4$ has naturally been set and hence the cassette roll continues to rotate until the end of the count by the counter $Q_{11}$, that is, until the cassette roll returns to the position of the section (A). If the flip-flop $Q_4$ is to be reset by the jam detection, it is advisable to reset the flip-flop $Q_{16}$ by the next CPB signal. As a result, the casette roll is forceably rotated to return to the position of the section (A).

Since the flip-flop $Q_3$ for controlling the clutch for the registration roll 17 is reset upon the occurrence of the jam, the sheet is not fed into the machine even if the sheet is fed by the return rotation of the roll 13.

If the manually inserted sheet jams, the main motor and all of the clutches are immediately deactivated because the flip-flop $Q_4$ is in the reset state and the jam process begins. When the roll 14 is similar to the roll 13, the above technique may be used.

According to the present invention, when the jam occurs, the cassette roll, wherever it is, continues to rotate for an appropriate time period to return to the initial position to be ready for the stable restart after the jam condition has been cleared.

Since the sheet is forceably moved from the cassette to the vicinity of the regist roll when the jam has occurred, the jam process is facilitated.

The JAM 1 occurs when the preceding paper has not reached the sheet sensor 63 in a first predetermined time period and the JAM 2 occurs when a small size paper is not ejected and passed through the sensor 63 in a second predetermined time period after the arrival at the sensor 63. The JAM 3 occurs when a large size paper is not ejected. Where a sensor for sensing the misfeed is positioned between the feed roll 13 and the registration roll 17, the misfeed may be the JAM 1 of the sheet being fed.

By stopping the belt 19, the rolls 21 and 201 and the fixing heater are stopped upon the detection of the jam, and a further jam condition is prevented. In the case of the misfeed, it is advantageous to continue the operations of those elements in order to allow the ejection of the paper.

In case of a trouble during the copy operation which causes the power to be turned off to suspend the machine operation, such as the break of the exposure lamp or the break of the forward or backward clutch, the JAM signal is produced upon detection of such a condition to effect the return control and the paper feed control.

Where the machine operation is suspended during the copy operation by inadvertently turning off the main switch, the same process may be carried out.

While the flip-flops are used to store the rotation positions in the illustrated embodiment, it may be possible to use a counter which counts the clock pulses CLK from the start of the rotation of the roll 13 and continues to count even after the stop of the rotation and decides the rotation time period and the number of revolutions after the jam in accordance with the count at the time when the jam is detected.

Alternatively, the signals to the rolls 13 and 17 and the clutches FWCl and BWCl may be blocked by the signal JAM upon the detection of the jam and the paper feed operation may be carried out after the jam process. This can be attained by producing a signal equivalent to the signal JAM when the jam reset switch is turned on to allow the copy operation before the copy start button is depressed or when the door of the copying machine is closed. In this case, means must be provided to keep the power supply of the circuit of FIG. 7-1 on when the door is opened, or the power supply for the flip-flops $Q_{15}$ and $Q_{16}$ must be backed up or the flip-flops $Q_{15}$ and $Q_{16}$ must be constructed by non-volatile memories in ROM.

The present invention may be used as a safety device for the interruption of the operation of the paper feed device whether it is the semi-circular roll or not, by an external condition. The increase of the trouble due to the jam can be prevented by the above process for not only the separation means for the cassette but also for the registration roll immediately forward of the transfer station or the intermediate registration roll, or other process movable members.

The present invention is very effective to the movable member which has no position sensor and is to be returned to a proper position for restart. In one example, a distance of movement of the text table in the normal scan state or the jam state is determined from the distance of the scan movement of the text table and a return distance of the text table is determined from the above distance of movement to carry out the return of the text table. In another example, the position of a latent image or a visible image formed on a seamless photosensitive drum is determined from the amount of rotation of the drum from the start of the rotation and a paper feed timing for the restart after the suspension is determined from the amount of the rotation to transfer the image.

The present invention is effective to not only the copying machine but also to an apparatus having a process movable member.

What we claim is:

1. An image forming apparatus comprising:

means for forming an image on a recording medium at an image forming station;

feed means for feeding said recording medium to said image forming station;

storing means for storing an operation state of said feed means; and control means for controlling the operation of said feed means in accordance with the content of said storing means.

2. An image forming apparatus according to claim 1 wherein said feed means is a rotating semi-circular paper feed roll for feeding a paper by contacting a portion of a periphery thereof to a paper stack.

3. An image forming apparatus according to claim 1 wherein said storing means stores the amount of movement of said feed means.

4. An image forming apparatus according to claim 1 wherein said control means moves said feed means to a predetermined position when a jam occurs.

5. An image forming apparatus according to claim 2 further comprising means located downstream of said feed means for registering the paper fed thereto to a text image.

6. An image forming apparatus comprising:

process means for forming an image on a recording medium, said process means including a movable member;

storing means for storing an operation state of said movable member; and means for controlling the movement of said movable member in accordance with the content of said storing means when the operation of said apparatus is suspended.

7. An image forming apparatus according to claim 6 wherein said control means continues the operation of said movable member in accordance with the content of said storing means when the operation of said apparatus is suspended.

8. An image forming apparatus according to claim 6 wherein said control means operates said movable member in accordance with a content of said storing means when said apparatus resumes its operation after the suspension thereof.

9. An image forming apparatus according to claim 6 wherein said control means operates to cause said movable member to be in a predetermined state.

10. An image forming apparatus according to claim 6 wherein said movable member comprises means for feeding said recording medium to an image forming station.

11. An image forming apparatus according to claim 10 wherein said movable member is controlled by said control means to move to a predetermined position when a jam occurs.

12. An image forming apparatus according to claim 6 wherein said storing means stores a signal corresponding to a position of said movable member.

13. An image forming apparatus comprising:

process means for forming an image on a recording medium at a recording station;

feed means for feeding said recording medium to said recording station;

means for generating a suspend signal; and means for controlling the driving of said feed means in accordance with the operation state of said feed means when said suspend signal is generated.

14. An image forming apparatus according to claim 13 wherein said generating means generates said suspend signal when said recording medium jam occurs in said apparatus.

15. An image forming apparatus according to claim 13 wherein said driving means drives said feed means to a predetermined state.

16. An image forming apparatus according to claim 13 wherein said process means suspends an image formation in response to said suspend signal.

17. An image forming apparatus comprising:

process means for forming an image on a recording medium;

means for generating a suspend signal;

storing means for storing a state of said apparatus when said suspend signal is generated; and means for starting the operation of said apparatus after the suspension from a predetermined state in accordance with the content of said storing means.

18. An image forming apparatus according to claim 17 wherein said process means suspends operation in response to said suspend signal.

19. An image forming apparatus according to claim 17 wherein said predetermined state is an initial state corresponding to the start of image formation.

20. An image forming apparatus according to claim 17 wherein said generating means generates said suspend signal when said apparatus is incapable of forming an image.

* * * * *